US011203468B2

(12) United States Patent
Ono

(10) Patent No.: US 11,203,468 B2
(45) Date of Patent: Dec. 21, 2021

(54) POURING SPOUT OF CONTAINER

(71) Applicant: FUJIMORI KOGYO CO., LTD., Shinjuku-ku (JP)

(72) Inventor: Matsutaro Ono, Shinjuku-ku (JP)

(73) Assignee: FUJIMORI KOGYO CO., LTD., Shinjuku-ku (JP)

( * ) Notice: Subject to any disclaimer, the term of this patent is extended or adjusted under 35 U.S.C. 154(b) by 73 days.

(21) Appl. No.: 16/496,103

(22) PCT Filed: Dec. 7, 2017

(86) PCT No.: PCT/JP2017/043946
§ 371 (c)(1),
(2) Date: Sep. 20, 2019

(87) PCT Pub. No.: WO2018/173382
PCT Pub. Date: Sep. 27, 2018

(65) Prior Publication Data

US 2020/0095033 A1 Mar. 26, 2020

(30) Foreign Application Priority Data

Mar. 21, 2017 (JP) ..... JP2017-054945

(51) Int. Cl.
*B65D 47/20* (2006.01)
*B65D 47/06* (2006.01)

(52) U.S. Cl.
CPC ..... *B65D 47/2018* (2013.01); *B65D 47/06* (2013.01)

(58) Field of Classification Search
CPC .... B65D 47/2018; B65D 47/20; B65D 47/04; B65D 47/06; B65D 33/16
(Continued)

(56) References Cited

U.S. PATENT DOCUMENTS

2002/0092867 A1 7/2002 Last
2014/0023297 A1* 1/2014 Zund ..... B65D 75/5883 383/43
(Continued)

FOREIGN PATENT DOCUMENTS

EP 3 020 649 A1 5/2016
JP 54-74648 U 11/1977
(Continued)

OTHER PUBLICATIONS

Extended European Search Report dated Sep. 14, 2020 in corresponding European Patent Application No. 17902257.2, 11 pages.
(Continued)

*Primary Examiner* — Steven A. Reynolds
*Assistant Examiner* — Javier A Pagan
(74) *Attorney, Agent, or Firm* — Oblon, McClelland, Maier & Neustadt, L.L.P.

(57) ABSTRACT

A pouring spout of a container includes a spout main body, a closing member, and an energizing body. The spout main body includes a tubular pouring part and an attached part. The tubular pouring part includes an inflow port through which contents are flown in from a container main body and an outflow port. The attached part is configured to attach the inflow port to the container main body. The closing member is configured as a separate body from the tubular pouring part and fitted onto an inner circumferential surface of the tubular pouring part to close the inflow port. The energizing body presses the closing member from the container main body toward the inflow port. The closing member is capable of being removed from the inner circumferential surface of the tubular pouring part by an external force applied against the pressing by the energizing body.

20 Claims, 11 Drawing Sheets

(58) Field of Classification Search
USPC ..... 220/254.1, 254.5
See application file for complete search history.

(56) References Cited

U.S. PATENT DOCUMENTS

| | | | | |
|---|---|---|---|---|
| 2017/0107024 | A1* | 4/2017 | Tamarin | B65D 75/5883 |
| 2018/0339818 | A1 | 11/2018 | Matsumoto et al. | |

FOREIGN PATENT DOCUMENTS

| | | | |
|---|---|---|---|
| JP | 10-120007 | A | 5/1998 |
| JP | 2003-165560 | A | 6/2003 |
| JP | 2005-67700 | A | 3/2005 |
| JP | 2010-105681 | A | 5/2010 |
| JP | 2013-203464 | A | 10/2013 |
| WO | WO 2015/145277 | A1 | 10/2015 |

OTHER PUBLICATIONS

International Search Report and Written Opinion dated Feb. 6, 2018 in PCT/JP2017/043946 filed Dec. 7, 2017.

* cited by examiner

POURING SPOUT OF CONTAINER

FIELD OF THE INVENTION

The present invention relates to a pouring spout of a container. More specifically, the present invention relates to a pouring spout used for a container such as a refill container storing contents for refilling a packaging container.

BACKGROUND ART

Liquid seasoning such as soy sauce and toiletry products such as liquid detergents are, for example, stored in a packaging container made of a resin or the like and consumed. Once a residual amount of the contents is decreased or depleted, such a packaging container is refilled with the contents and the same packaging container is repeatedly used. In such products, a refill container storing the contents for refilling is prepared separately from the packaging container. As the refill container, various types have been proposed.

For example, the refill container proposed in Patent Document 1 is designed to prevent outside air from flowing into the refill container from a spout. This refill container prevents the contents from coming into contact with outside air and changing in quality, and is configured to refill the packaging container with the contents, allowing repeated use of the packaging container. The packaging container includes a pouring unit for pouring the contents. The pouring unit is configured by including a pouring nozzle and a peripheral wall provided to a periphery of the pouring nozzle. The refill container is configured so that a pouring spout is coupled to the pouring unit of the packaging container thus configured to refill the packaging container with contents.

Specifically, the refill container includes a flat plate. This flat plate closes a spout used in the refill container at a position of a pouring hole, and prevents the contents from being exposed to outside air. This flat plate has substantially the same shape as an outer circumference of the pouring nozzle of the packaging container. The flat plate includes a portion to be opened on an inner side of the edge portion of the flat plate. The portion to be opened is provided by forming a weak line having a weak strength around the portion. An area on an inner side of the weak line is configured to be separated from the flat plate by an external force being applied thereto. In this refill container, when the pouring nozzle of the pouring unit provided to the packaging container is inserted into an interior of the pouring spout of the refill container, the pouring nozzle breaks the flat plate at the position of the weak line described above, separating a region on the inner side from the flat plate. With the portion of the inner side of the weak line separated from the flat plate, the refill container is configured to communicate the inside and outside of the refill container and allow transfer of the contents filled in the interior of the refill container into the packaging container.

PATENT DOCUMENTS

Patent Document 1: Japanese Laid-Open Patent Application No. 2013-203464

SUMMARY OF THE INVENTION

Problems to be Solved by the Invention

In the refill container in Patent Document 1, a weak part is formed in the flat plate provided to the spout, allowing separation of the inner side of the weak part. That is, in the flat plate, an inner side and an outer side of the weak part are configured by a single member. However, when the pouring nozzle is inserted, the inner side of the weak part may not smoothly separate from the flat plate. When this happens, the pouring nozzle of the packaging container locally breaks through the flat plate, forming a hole in a sealing plate. When a hole is formed in the flat plate, broken pieces of the flat plate may be produced. When broken pieces are produced, the broken pieces may penetrate the packaging container and clog the pouring nozzle of the packaging container.

Further, the refill container is based on the premise that all of the contents of the refill container are transferred into the packaging container in one refilling task. Nevertheless, when the capacity of the packaging container is less than the capacity of the refill container, it is necessary to transfer the contents stored in the refill container into the packaging container by dividing the contents several times. In such a refill container, to prevent the remaining contents from changing in quality, the spout is preferably re-closed at the position of the pouring hole after the packaging container is refilled with the contents from the refill container.

The present invention is made to resolve the above-described problems, and an object of the present invention is to provide a pouring spout of a container that makes it possible to open and close a closing member that closes a tubular pouring part of a pouring spout without producing broken pieces or the like, and prevent a change in quality of contents remaining in a refill container, even when the contents are transferred by dividing the contents several times.

Means for Solving the Problems

A pouring spout of a container according to the present invention for solving the above-described problems is a pouring spout of a container comprising a spout main body including a tubular pouring part provided with an inflow port for allowing contents to flow in and an outflow port for allowing contents to flow out, and an attached part for attaching the inflow port side to a container main body part; a closing member configured as a separate body from the tubular pouring part and fitted onto an inner circumferential surface of the tubular pouring part in a mode that allows the inflow port to be opened and closed; and an energizing body that energizes the closing member from the container main body part side toward the inflow port and blocks the inflow port by the closing member. The closing member is removed from the inner circumferential surface of the tubular pouring part against an energizing force of the energizing body by an external force applied from the outflow port side.

According to this invention, the pouring spout of a container includes the energizing body that energizes the closing member from the container main body part side toward the inflow port and blocks the inflow port by the closing member, and the closing member is removed from the inner circumferential surface of the tubular pouring part against the energizing force of the energizing body by an external force applied from the outflow port side, making it possible to open and close the inflow port of the tubular pouring part. Thus, even in a case where a packaging container is to be refilled with contents of a refill container provided with the pouring spout by dividing the contents several times, it is possible to keep outside air from entering an interior of the refill container after the packaging container is refilled with the contents of the refill container at a certain time until the packaging container is refilled with the contents the next time. Thus, even when contents remain in the refill container, it is possible to keep the contents from coming into contact with outside air and changing in quality.

In the pouring spout of a container according to the present invention, the energizing body includes a holding body inserted from the attached part into an interior of the container main body part, and a spring member attached to the holding body. The spring member couples the holding body and the closing member.

According to this invention, the holding body constituting the energizing body is inserted into the interior of the container main body part, and the holding body and the closing member are coupled by the spring member, making it possible to smoothly pour the contents without the energizing body hindering the flow of the contents when the contents are poured from the refill container.

In the pouring spout of a container according to the present invention, the attached part and the energizing body are configured as an integrated object.

According to this invention, the attached part and the energizing body are an integrated object, making it possible to manufacture the pouring spout using a manufacturing method capable of molding the pouring spout including the energizing body in one step of injection molding or the like.

In the pouring spout of a container according to the present invention, the energizing body is provided with an attachment mechanism capable of attaching the energizing body to the attached part.

According to this invention, the energizing body is provided with an attachment mechanism capable of attaching the energizing body to the attached part, making it possible to manufacture the portion of the main body of the pouring spout and the portion of the energizing body separately, and subsequently combine the two to manufacture a finished product.

Effect of the Invention

According to the present invention, it is possible to move a closing member that closes a tubular pouring part of the pouring spout to open and close the tubular pouring part without producing broken pieces or the like, and transfer contents from a transfer container into a packaging container by dividing the contents several times.

EMBODIMENTS OF THE INVENTION

Figure 1:
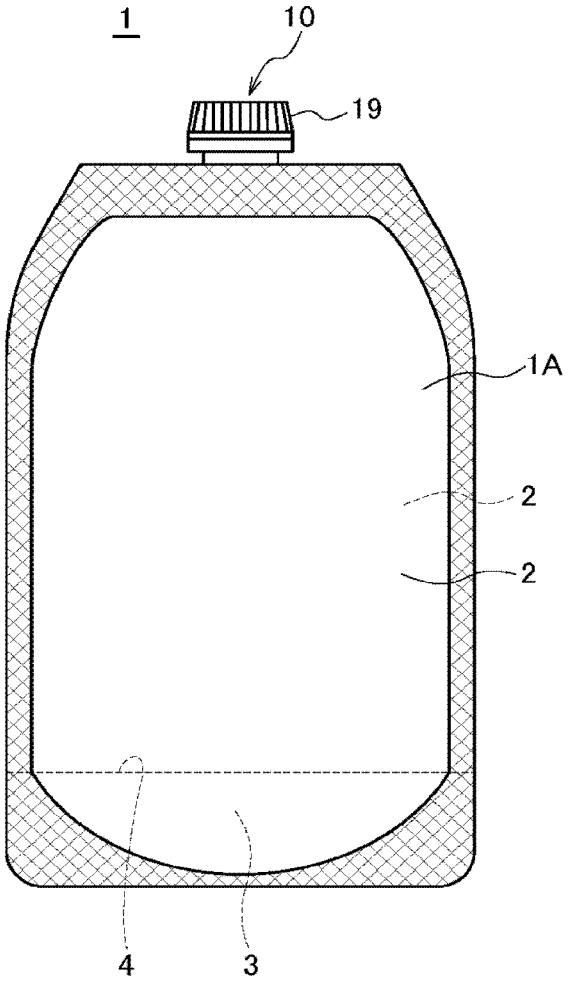
FIG. 1 is a plan view of a standing pouch serving as a refill container provided with a pouring spout according to the present invention.

An embodiment of the present invention is described below with reference to the drawings. The present invention includes inventions of the same technical idea as the modes set forth in the embodiments and drawings below, and the technical scope of the present invention is not limited to those described in the embodiments and drawings. In this specification, a pouring spout is referred to as a "pouring spout 10" when including the pouring spouts 10A, 10B, 10C, 10D in each mode, and as the "pouring spout 10A" or the like when referring to a pouring spout of an individual mode.

Basic Configuration

A pouring spout 10 of a container according to the present invention includes a tubular pouring part 11, an attached part 15, a closing member 20, and an energizing body 50. The tubular pouring part 11 includes an inflow port 10*d* for allowing contents stored in a refill container provided with this pouring spout 10 to flow in, and an outflow port 10*c* for allowing the contents to flow out. The attached part 15 is an area for attaching the inflow port 10*d* side to a container main body part 1A constituting the refill container. The closing member 20 is fitted onto an inner circumferential surface of the tubular pouring part 11 in a mode that allows the inflow port 10*d* to be opened and closed. This closing member 20 is configured as a separate body from the tubular pouring part 11. The energizing body 50 is a component that energizes the closing member 20 from the container main body part 1A side toward the inflow port 10*d*, and blocks the inflow port 10*d* by the closing member 20. The closing member 20 is configured to be removed from the inner circumferential surface of the tubular pouring part 11 against an energizing force of the energizing body 50 by an external force applied from the outflow port 10*c* side.

According to the present invention, it is possible to move the closing member 20 that closes the tubular pouring part 11 of the pouring spout 10 at the position of the inflow port 10*d* to open and close the tubular pouring part 11 without producing broken pieces or the like, and transfer contents from a transfer container into a packaging container 30 by dividing the contents several times.

The following describes an overview of a transfer container provided with the pouring spout 10, a specific configuration of the pouring spout 10, an overview of the packaging container 30 used by being refilled with contents from the transfer container, and the action of the pouring spout 10. "Packaging container" refers to a container refilled with contents, and "container" refers to a container used as a refilling container or the like storing contents for refilling the packaging container with contents and provided with the pouring spout according to the present invention.

Transfer Container Provided with Pouring Spout

The transfer container provided with a pouring spout 10A according to the present invention is mainly used for refilling the packaging container 30 used separately from the transfer container with contents. The modes and types of the refill container are not particularly limited. FIG. 1 shows a standing pouch 1 as an example of the refill container. This standing pouch 1 includes a pair of flat surface parts 2 facing each other, a bottom surface part 3 that closes a bottom part of the refill container, and the pouring spout 10A.

The flat surface parts 2 are sealed together at an upper edge, and sealed together at both side edges. Lower edges of the flat surface parts 2 are each sealed at an edge part of the bottom surface part 3 facing the lower edge of the flat surface part 2. The bottom surface part 3 is folded in half at a crease 4 at a center thereof, and the crease 4 is folded toward an upper side of the standing pouch 1. The bottom surface part 3 is configured to allow a bottom part of the standing pouch 1 to be unfolded by unfolding from the folded mode in the directions in which the flat surface parts 2 of the standing pouch 1 are disposed.

The pouring spout 10A is attached to an upper edge of the standing pouch 1. The pouring spout 10A is configured by a spout main body 10*a* and a cap 19 that freely opens and closes the outflow port 10*c* side of the tubular pouring part 11 of the spout main body 10*a*. In this embodiment, a case where the pouring spout 10A is attached to a middle of an upper part of the standing pouch 1 is given as an example. However, while not particularly illustrated in the drawings, the pouring spout 10A may be provided in a position shifted to a side part in a width direction, in the upper part of the standing pouch 1. Further, the standing pouch 1 may be provided with an area communicated by an inclined part where the upper edge and the side edge are obliquely inclined in the container main body part 1A, and the pouring spout 10A may be attached to the inclined part.

The standing pouch 1 is, for example, used as a refill container for transferring the contents into the packaging container 30 (refer to FIG. 4) prepared separately from the standing pouch 1. When the contents are transferred into the packaging container 30, the cap 19 that closes the pouring spout 10A is removed, and the standing pouch 1 is turned upside down. Then, the pouring spout 10A is inserted into a pouring unit 40 of the packaging container 30, and the contents are transferred directly from the standing pouch 1 into the packaging container 30. Note that this action is described in detail later.

Pouring Spout

Figure 2:
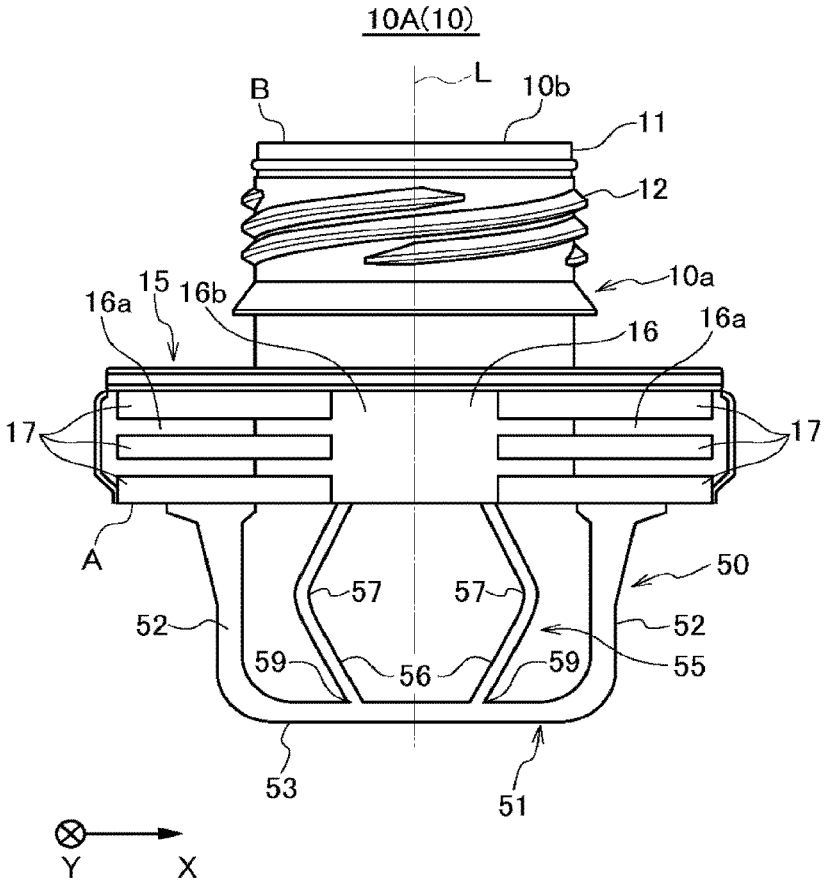
FIG. 2 is a side view illustrating a side part of the pouring spout of an embodiment according to the present invention.
Figure 3:
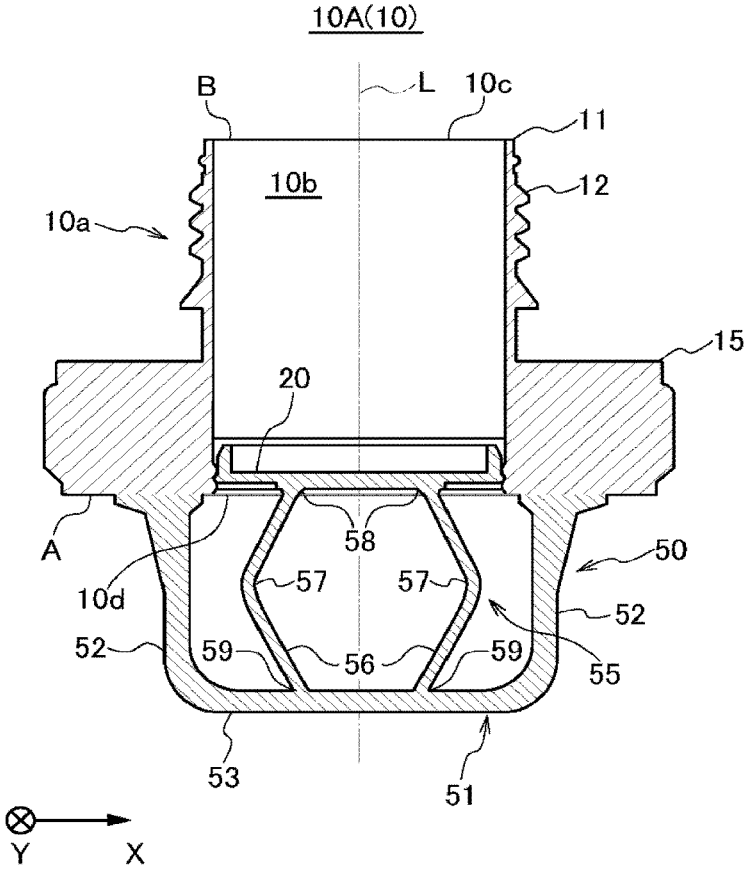
FIG. 3 is a longitudinal sectional view of the pouring spout illustrated in FIG. 2 taken along a central part in a longitudinal direction of FIG. 2 in its entirety.

The pouring spout 10A, as illustrated in FIG. 2 and FIG. 3, includes the tubular pouring part 11 and the attached part 15. The tubular pouring part 11 forms a cylinder. The attached part 15 is an area for attachment to the upper edge of the container main body part 1A. The attached part 15 is provided on one end A side of the tubular pouring part 11 in a direction of an axis L. The tubular pouring part 11 is an area used when the contents of the standing pouch 1 provided with the pouring spout 10A are poured from the standing pouch 1. The tubular pouring part 11 has a hollow interior, and is open in a circular shape at both ends in the direction of the axis L. That is, a channel 10*b* is formed in an interior of the tubular pouring part 11. Thus, the tubular pouring part 11 is configured to allow an inner side and an outer side of the standing pouch 1 to communicate. In the tubular pouring part 11, the one end A side in the direction of the axis L is the inflow port 10*d* for allowing the contents stored in the refill container to flow into the tubular pouring part 11, and the other end B side in the direction of the axis L is the outflow port 10*c* for allowing the contents to flow out from the tubular pouring part 11.

A thread part 12 is formed on an outer circumferential surface of the tubular pouring part 11. The thread part 12 extends in a circumferential direction, shifts position in the direction of the axis L, and has a spiral shape. This thread part 12 is an area that engages with a thread part (not illustrated) formed on an inner surface of the cap 19. The tubular pouring part 11 is configured so that, with the thread part of the cap 19 engaged with the thread part 12, the other end B side of the tubular pouring part 11 is closed and opened.

The attached part 15 has a boat shape. A boat shape refers to a shape in which side surface parts 16 of the attached part 15 on both sides in a horizontal direction (direction denoted by reference sign Y in FIG. 2 and FIG. 3) protrude toward the outer sides, and have acute angles that come to a point on both sides in a vertical direction (direction denoted by reference sign X in FIG. 2 and FIG. 3). Heights of the side surface parts 16 are uniformly formed.

Each of the side surface parts 16 is configured by an inclined surface part 16*a* that inclines from a center toward the outer side in the Y direction, from both ends in the X direction toward the middle, and a curved part 16*b* that protrudes toward the outer sides in the Y direction in a central portion in the X direction. The curved part 16*b* has an arc shape when the pouring spout 10A is viewed from the one end A side. Further, a plurality of protruding parts 17 extending in the vertical direction are formed on each of the side surface parts 16, as illustrated in FIG. 2.

Closing Member

The closing member 20 is a component for blocking the inflow port 10*d* of the channel 10*b* formed in the pouring spout 10A. The closing member 20 is configured as a separate body from the spout main body 10*a*. This closing member 20 has a disk shape. The closing member 20 blocks the inflow port 10*d* of the channel 10*b* by being fit onto the one end A side of the tubular pouring part 11 in the direction of the axis L, that is, an inner side of the channel 10*b* at the position of the inflow port 10*d*. This closing member 20 is energized from the container main body part 1A side toward the inflow port 10*d* by the energizing body 50 described later. The closing member 20 that blocks the channel 10*b* of the pouring spout 10A is removed from the inner circumferential surface of the tubular pouring part 11 against the energizing force of the energizing body 50 by an external force applied from the outflow port 10*c* on the other end B side opposite to the one end A side of the tubular pouring part 11 in the direction of the axis L. Thus, a diameter of the closing member 20 is formed to the same size as or slightly smaller than an inner diameter of the channel 10*b* of the pouring spout 10A.

The channel 10*b* of the pouring spout 10A of this embodiment has a circular cross-sectional shape, and thus the closing member 20 fitted into the channel 10*b* also has a circular outer shape. However, the outer shape of the closing member 20 is formed into a shape corresponding to the cross-sectional shape of the channel 10*b*. For example, when the channel 10*b* has an elliptical cross-sectional shape, the outer shape of the closing member 20 is formed into an elliptical shape corresponding to the cross-sectional shape of the channel 10*b*. With the outer shape of the closing member 20 formed into a shape corresponding to the cross-sectional shape of the channel 10*b* of the pouring spout 10A, the closing member 20 blocks the channel 10*b* without forming a gap between the closing member 20 and the inner circumferential surface of the channel 10*b* of the pouring spout 10A when the closing member 20 is fit onto the inner side of the inflow port 10*d* of the channel 10*b* formed in the pouring spout 10A.

Energizing Body

The energizing body 50 is a component for energizing the closing member 20 from the container main body part 1A side toward the inflow port 10*d*, and blocking the inflow port 10*d* by the closing member 20. The closing member 20 is configured to be removed from the channel 10*b* against the energizing force of the energizing body 50 by an external force applied from the outflow port 10*c* side as mentioned above. This energizing body 50 is configured by a holding body 51 and a spring member 55. The holding body 51 is configured by a pair of columns 52 extending downward from an attachment member, and a beam 53 connecting lower ends of the pair of columns 52. The holding body 51 is inserted from the attached part 15 into an interior of the container main body part 1A. The spring member 55 is attached to the holding body 51. Specifically, the spring member 55 is disposed between the column 52 and the column 52, is attached to the beam 53 of the holding body 51 at a lower end part 59, and is attached to the closing member 20 at an upper end part 58. That is, the spring member 55 communicates the holding body 51 and the closing member 20. More specifically, the spring member 55 communicates the beam 53 constituting the holding body 51 and a lower surface of the closing member 20. While the spring member 55 is configured by at least one spring member, in order to press the closing member 20 against the inflow port 10*d* without inclination, preferably the spring member 55 is disposed using two or more spring members, making the pressing force equal.

The spring member 55 of the example illustrated in FIG. 2 and FIG. 3 is configured by two spring constituting members 56, each including a bending part 57 in the center in the direction of the axis L. In the two spring constituting members 56, the bending part 57 is positioned on an outer side of the upper end part 58 and the lower end part 59. That is, the space between the spring constituting members 56 is configured smallest at the positions of the upper end part 58 and the lower end part 59, and largest at the position of the bending part 57. Thus, the spring member 55 consisting of the two spring constituting members 56 has an elastic force, and energizes the closing member 20 toward the inflow port 10*d* of the channel 10*b* utilizing the elastic force. On the other hand, when an external force acts from the outflow port 10*c* side in the closing member 20 toward the container main body part 1A, the two spring constituting members 56 flex so that a degree of bending at the position of the bending part 57 increases.

The spout main body 10*a*, the holding body 51, the spring member 55, and the closing member 20 described above are configured as an integrated object made from the same material. Examples of a method for configuring these as an integrated object include injection molding. Further, the spout main body 10*a*, the holding body 51, the spring member 55, and the closing member 20 are molded using a resin such as polyethylene, polypropylene, polyester, ethylene-vinyl copolymer, and polyvinyl chloride. However, the material of the pouring spout 10A is not limited as long as the pouring spout is moldable and adherable to the standing pouch 1.

Further, as described later, the spout main body 10*a* and the energizing body 50 can also be configured as separate bodies. Examples of a method for molding these as separate bodies include injection molding. In this case, different resins can be used for the spout main body 10*a* and the energizing body 50, the material of the spout main body 10*a* is not limited as long as the spout main body is moldable and adherable to the standing pouch 1, and the material of the energizing body 50 is not limited as long as the energizing body is moldable. In this case, the energizing body 50 serving as a separate body from the spout main body 10*a* need not be adhered to the container main body part 1A of the standing pouch 1, and thus a material not adherable to the pouch may be used. Further, examples of applicable raw materials of the resin include petroleum-derived materials, plant-derived materials, copolymers thereof, blend resins thereof, and the like.

Packaging Container

Figure 4:
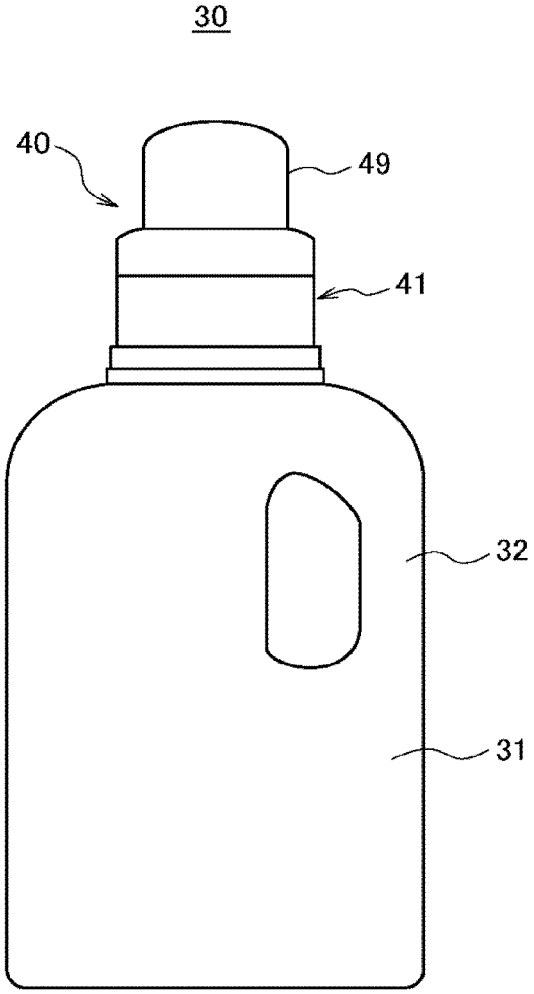
FIG. 4 is a side view illustrating a side part of a packaging container to be refilled with contents from the refill container.

The packaging container 30 is a container used by being refilled with contents stored in the standing pouch 1. The packaging container 30 is configured by a resin or the like, for example. FIG. 4 shows an example of the packaging container 30. The packaging container 30 illustrated in FIG. 4 is configured by a container main body part 31 provided with a handle 32, and the pouring unit 40 for pouring the contents stored in the container main body part 31. This packaging container 30 is used by removing from the packaging container 30 the contents moved from the standing pouch 1 in an amount required when necessary.

Figure 5:
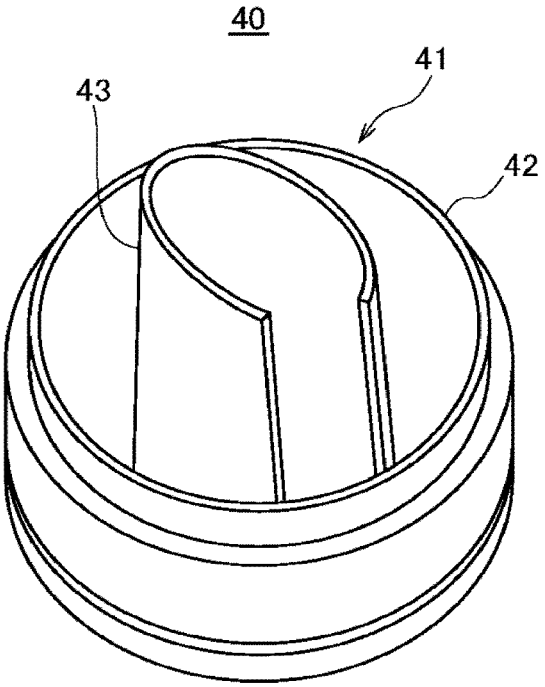
FIG. 5 is a perspective view of a pouring unit constituting the packaging container illustrated in FIG. 4.

The pouring unit 40 of the packaging container 30 is configured by a main body part 41, and a cap 49 for opening and closing the main body part 41. The main body part 41, as illustrated in FIG. 5, includes a peripheral wall surface 42, and a nozzle 43 disposed on an inner side of this peripheral wall surface 42. The peripheral wall surface 42 has a tubular shape. The inner side of the peripheral wall surface 42 is hollow.

The nozzle 43 is disposed in a middle or substantial middle position of the main body part 41. The nozzle 43 is connected to the peripheral wall surface 42, and is integrated with the peripheral wall surface 42. The nozzle 43 is configured to protrude toward an upper side of the main body part 41, with a tip end thereof positioned on an upper side of the upper end of the peripheral wall surface 42. FIG. 5 shows one example of the shape of the nozzle 43, and the shape of the nozzle 43 is not particularly limited.

Manufacturing Method of Pouring Spout

The pouring spout 10 can be manufactured by various manufacturing methods. When the spout main body 10*a*, the energizing body 50, and the closing member 20 are integrally molded, when the spout main body 10*a* and the energizing body 50 are configured as separate bodies as described later, or the like, molding may be performed by injection-molding a resin, taking into consideration manufacturing efficiency, manufacturing cost, and quality. For the manufacturing method for injection-molding the resin, once a mold is manufactured, products having the identical quality can be repeatedly manufactured.

Figure 6A:
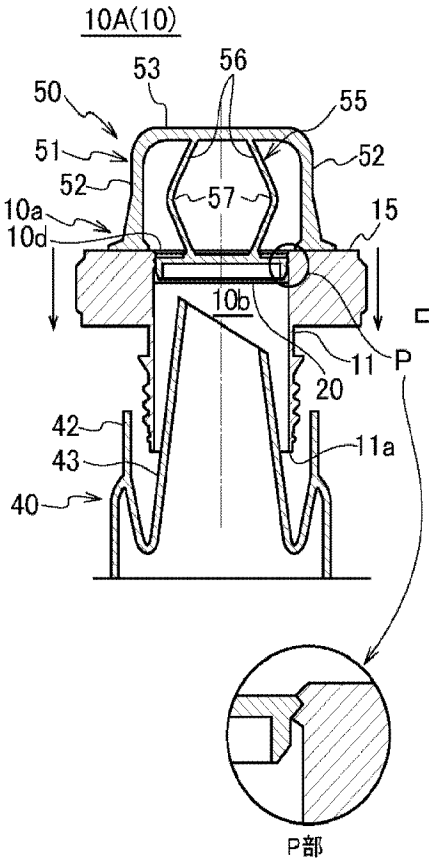
FIGS. 6A, 6B, and 6C are explanatory views for explaining an action of the pouring spout according to the present invention.

Procedure for Refilling Packaging Container with Contents and Action of Pouring Spout The procedure for refilling the packaging container 30 with the contents stored in the standing pouch 1, and the action of the pouring spout 10A of this embodiment will now be described with reference to FIGS. 6A to 6C. Note that, to make the action of the pouring spout 10A easy to understand, the standing pouch 1 and the container main body part 1A of the packaging container 30 are not illustrated in FIGS. 6A to 6C. However, the pouring spout 10A is attached to the standing pouch 1, which is a refill container, illustrated in FIG. 1, and the pouring unit 40 is provided to the packaging container 30 illustrated in FIG. 4.

First, the cap 19 is removed from the pouring spout 10A, the standing pouch 1 is turned upside down, and the pouring spout 10A is positioned on a lower side of the standing pouch 1. As illustrated in FIG. 6A, the channel 10*b* of the pouring spout 10A is closed by the closing member 20, and thus the contents stored in the standing pouch 1 never spill out. Specifically, as in the enlarged view illustrating an area P of FIG. 6A, a peripheral edge of the closing member 20 is inserted into a groove formed in an inner edge of the inflow port 10*d*. Thus, even when the pouring spout 10A of the standing pouch 1 is oriented to a lower side, the closing member 20 is held at the position of the inflow port 10*d*. As a result, the closing member 20 prevents the contents stored in the standing pouch 1 from flowing into the channel 10*b*. Next, as illustrated in FIG. 6A, the pouring spout 10A is matched with the position of the pouring unit 40 of the packaging container 30, and the nozzle 43 of the pouring unit 40 is inserted into the channel 10*b* of the pouring spout 10A. That is, the nozzle 43 of the pouring unit 40 is inserted into the channel 10*b* configured on the inner side of the tubular pouring part 11 constituting the pouring spout 10A.

Next, with the nozzle 43 inserted into the tubular pouring part 11, the pouring spout 10A is pressed further downward on the pouring unit 40 side. When the pouring spout 10A is pressed downward, the tip end of the nozzle 43 presses the closing member 20 upward. Thus, as illustrated in FIG. 6B, the closing member 20 is removed from the inflow port 10*d* of the channel 10*b*. Specifically, the closing member 20 is removed from the inflow port 10*d* by an external force applied from the outflow port 10*c* side of the tubular pouring part 11 toward the inner side of the container main body part 1A of the standing pouch 1. At this time, the closing member 20 moves to the beam 53 side (interior side of the container main body part 1A) against the energizing force of the spring member 55 constituting the energizing body 50. The closing member 20 is configured as a separate body from the spout main body 10*a*. Further, the closing member 20 closes the channel 10*b* by simply being fitted into the inflow port 10*d*. Thus, when the nozzle 43 moves the closing member 20, the closing member 20 is simply disengaged from the inflow port 10*d*, and smoothly removed from the inflow port 10*d* without being broken. As a result, foreign matter such as broken pieces is not produced, and only the contents are moved from the standing pouch 1 into the packaging container 30.

Figure 6B:
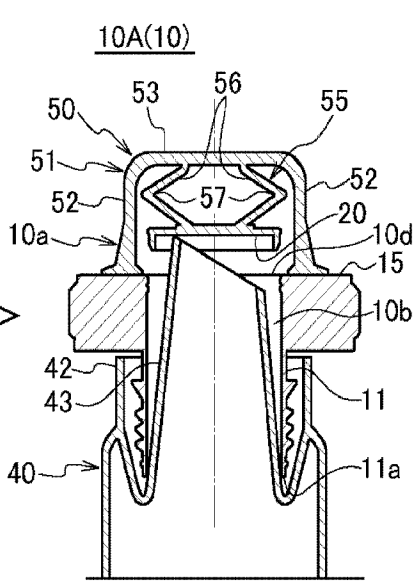
Figure 6C:
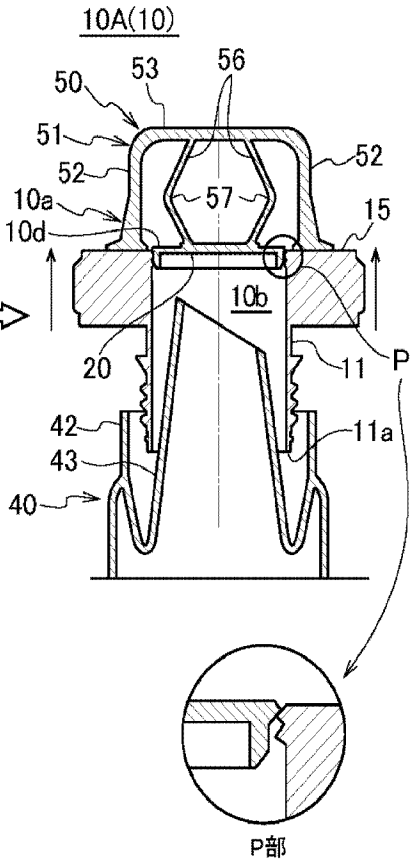

Further, as illustrated in FIG. 6B, when the closing member 20 is moved, a tip end part 11*a* of the tubular pouring part 11 comes into contact with the outer circumferential surface of the nozzle 43. Thus, the contents poured from the standing pouch 1 are moved to the packaging container 30 through the nozzle 43 without leaking to the outer side of the nozzle 43.

After a required amount of the contents is transferred from the standing pouch 1 into the packaging container 30, the standing pouch 1 is separated from the packaging container 30. At that time, as illustrated in FIG. 6C, the closing member 20 is energized toward the inflow port 10*d* by the spring member 55 of the energizing body 50 by the energizing body that energizes the closing member 20. As a result, the closing member 20 removed from the inner circumferential surface of the tubular pouring part 11 is energized toward the inflow port 10*d* by the energizing force of the energizing body 50, blocking the inflow port 10*d* and closing the channel 10*b* again. Specifically, as in the enlarged view illustrating the area P of FIG. 6C, the peripheral edge of the closing member 20 is abutted against a sheet surface formed on the inflow port 10*d*, blocking the inflow port 10*d*. The channel 10*b* is closed by the closing member 20, and thus the contents stored in the standing pouch 1 never leak from the channel 10*b* to outside the tubular pouring part 11. Further, it is possible to prevent outside air from entering the interior of the standing pouch 1 from the channel 10*b*.

Figure 7:
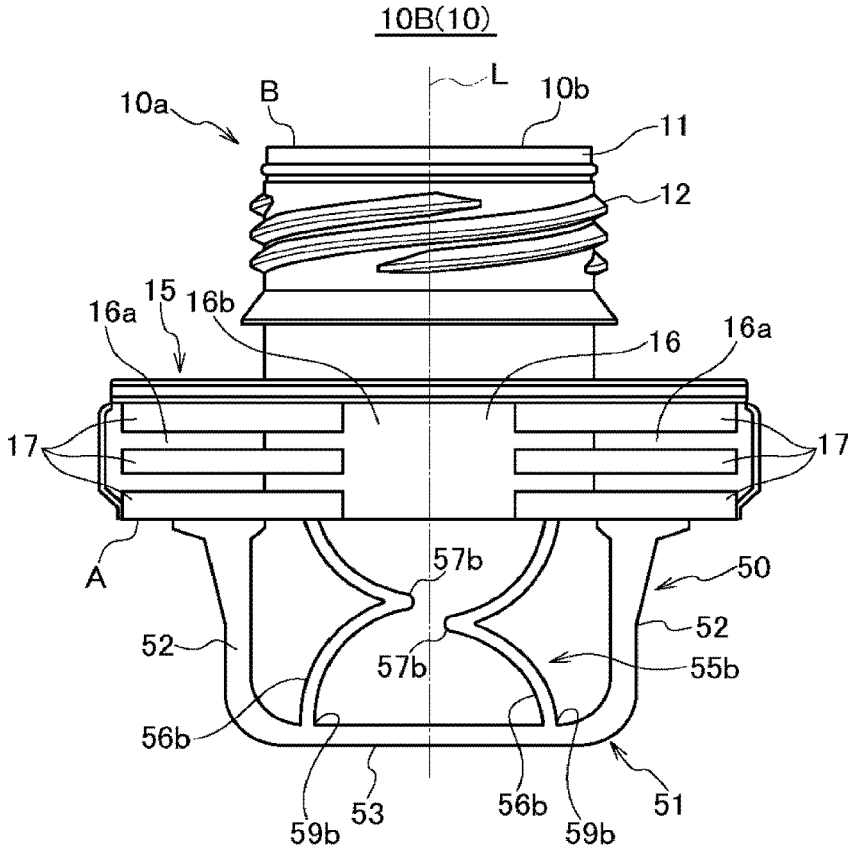
FIG. 7 is a side view illustrating a side part of the pouring spout in a mode different from that of the pouring spout of FIG. 2 and FIG. 3.

A pouring spout 10B illustrated in FIG. 7 includes the spring member 55 of a type different from that of the pouring spout 10A illustrated in FIG. 2 and FIG. 3. However, in this pouring spout 10B, the components other than the spring member 55 are the same as the components of the pouring spout 10A illustrated in FIG. 2 and FIG. 3. In the pouring spout 10B in the mode illustrated in FIG. 7, the same components as those of the pouring spout 10A illustrated in FIG. 2 and FIG. 3 are denoted using the same reference numerals in the drawings, and descriptions thereof are omitted.

Pouring Spout Including Spring Member of Different Type

However, in the energizing body 50 of this pouring spout 10B, the mode of a spring member 55*b* differs from the mode of the spring member 55 of the pouring spout 10A illustrated in FIG. 2 and FIG. 3. The spring member 55*b* is configured by two spring constituting members 56*b*. Each of the spring constituting members 56*b* includes a bending part 57*b* in a middle region in the direction of the axis L. Each of the spring constituting members 56*b* bends to the center of the energizing body 50 in the width direction at a position of the bending part 57*b*. In the two spring constituting members 56*b*, the bending part 57*b* is positioned on an inner side of an upper end part 58*b* and a lower end part 59*b* of the spring constituting member 56*b*. That is, the space between the spring constituting members 56*b* is largest at the position of the upper end part 58*b* and the lower end part 59*b*, and smallest at the position of the bending part 57*b*. Further, the position of the bending part 57*b* of each of the spring constituting members 56*b* is shifted in the direction of the axis L. In each of the spring constituting members 56*b* of the example illustrated in FIG. 7, the portion of the upper side and the portion of the lower side of the bending part 57*b* have a curved shape. Specifically, in each of the spring constituting members 56*b*, the portion of the upper side of the bending part 57*b* has a convex shape on the lower side, and the portion of the lower side of the bending part 57*b* has a convex shape on the upper side. However, the portion of the upper side and the portion of the lower side of the bending part 57*b* may be formed in a linear shape.

Figure 8:
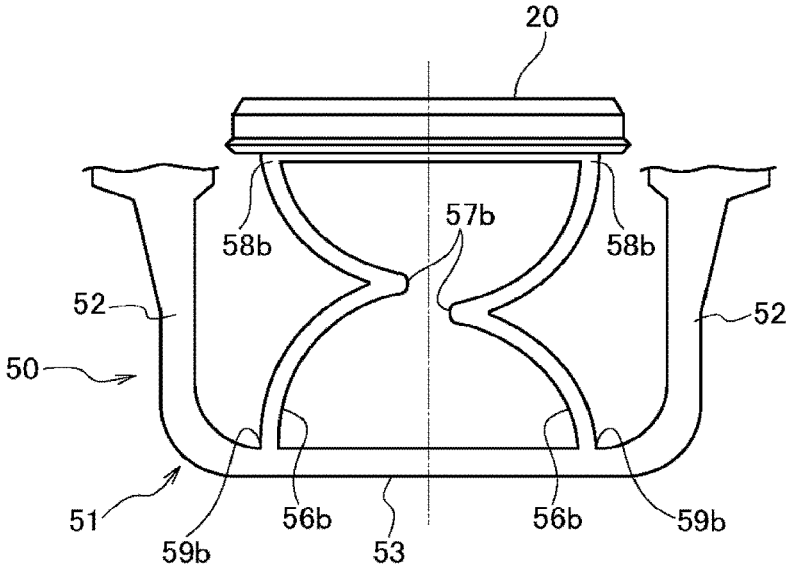
FIG. 8 is a side view of an energizing body constituting the pouring spout of FIG. 7.

In the pouring spout 10B illustrated in FIG. 7 and FIG. 8, the nozzle 43 of the packaging container 30 presses the closing member 20 upward and, when each of the spring constituting members 56*b* flexes, the bending part 57*b* moves toward the spring constituting member 56*b* on the opposing other side. The positions of the bending parts 57*b* are shifted in the direction of the axis L as described above, and thus the bending parts 57*b* never collide. Thus, each of the spring constituting members 56*b* can smoothly flex, and the length of the spring member 55*b* in the direction of the axis L freely changes.

Figure 9:
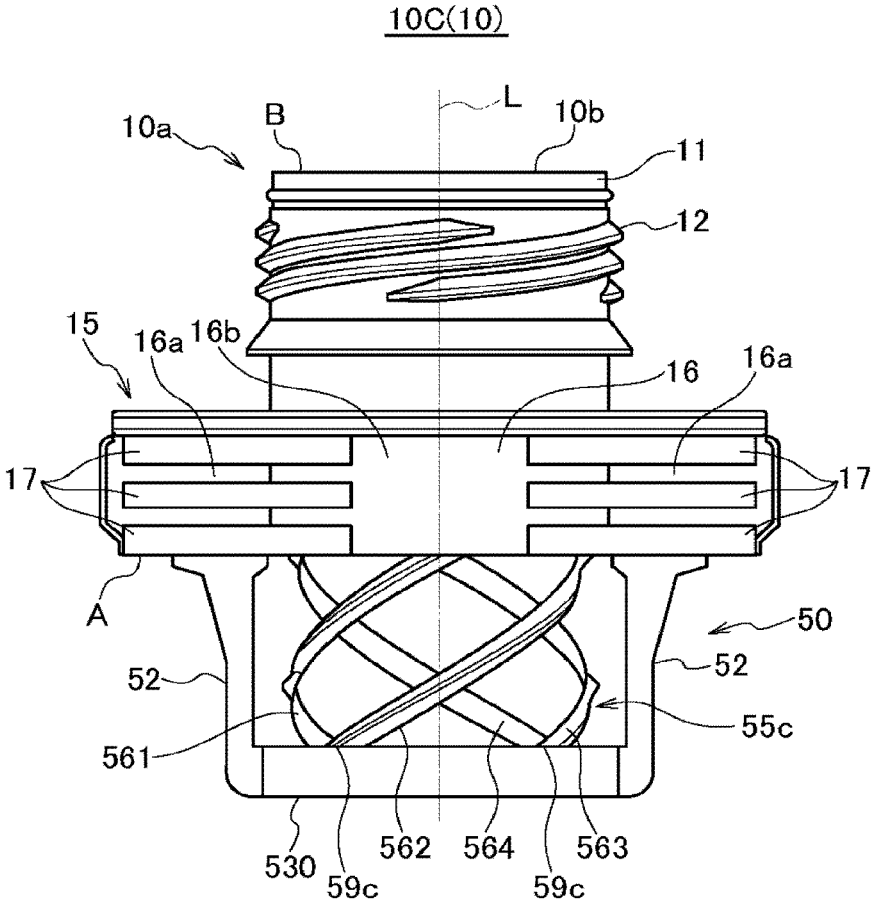
FIG. 9 is a side view illustrating a side part of the pouring spout in a mode different from that of the pouring spout of FIG. 2 and FIG. 3.
Figure 10:
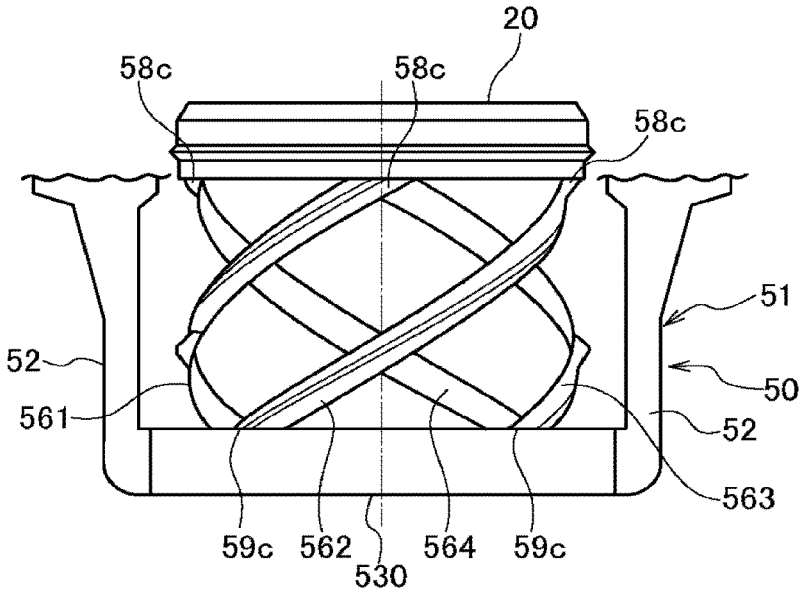
FIG. 10 is a side view of the energizing body constituting the pouring spout.

The pouring spout 10A illustrated in FIG. 9 and FIG. 10 includes a spring member 55*c* (refer to FIG. 10) of a type different from those of the pouring spouts 10A, 10B illustrated in FIG. 2, FIG. 3, and FIG. 7. However, in this pouring spout 10A as well, the components other than the spring member 55*c* are the same as the components of the pouring spout 10A illustrated in FIG. 2 and FIG. 3. In a pouring spout 10C in this mode, the same components as those of the pouring spout 10A illustrated in FIG. 2 and FIG. 3 are denoted using the same reference numerals in the drawings, and descriptions thereof are omitted.

The spring member 55*c* constituting the energizing body 50 of this pouring spout 10C is configured by four spring constituting members 561, 562, 563, 564 as illustrated in FIG. 9 and FIG. 10. Each of the spring constituting members 561, 562, 563, 564 has a spiral shape. Specifically, each of the spring constituting members 561, 562, 563, 564 extends in a circumferential direction around the center of the pouring spout 10C, and extends in the direction of the axis L. The four spring constituting members 561, 562, 563, 564 are each attached to a ring 530 at respective lower end parts 59*c* at positions shifted 90° in the circumferential direction from each other, and to the closing member 20 at respective upper end parts 58*c* at positions shifted 90° in the circumferential direction from each other. While the upper end parts 48*c* and the lower end parts 49*c* of the four spring constituting members 561, 562, 563, 564 are attached to the closing member 20 and the ring 530 at positions shifted 90° from each other in FIG. 9 and FIG. 10, attachment is not limited to positions shifted 90° as long as energization is possible without inclination of the closing member 20.

In the pouring spout 10C illustrated in FIG. 9 and FIG. 10, the four spring constituting members 561, 562, 563, 564 are evenly disposed in the circumferential direction and thus, when the nozzle 43 of the packaging container 30 presses the closing member 20 upward and each of the spring constituting members 561, 562, 563, 564 flexes, the closing member 20 is moved without inclination. Thus, when the closing member 20 is temporarily pressed upward by the nozzle 43 of the packaging container 30 and the closing member 20 closes the channel 10*b* again, the closing member 20 blocks the inflow port 10*d*.

Spout Main Body and Energizing Body as Separate Bodies

Figure 11:
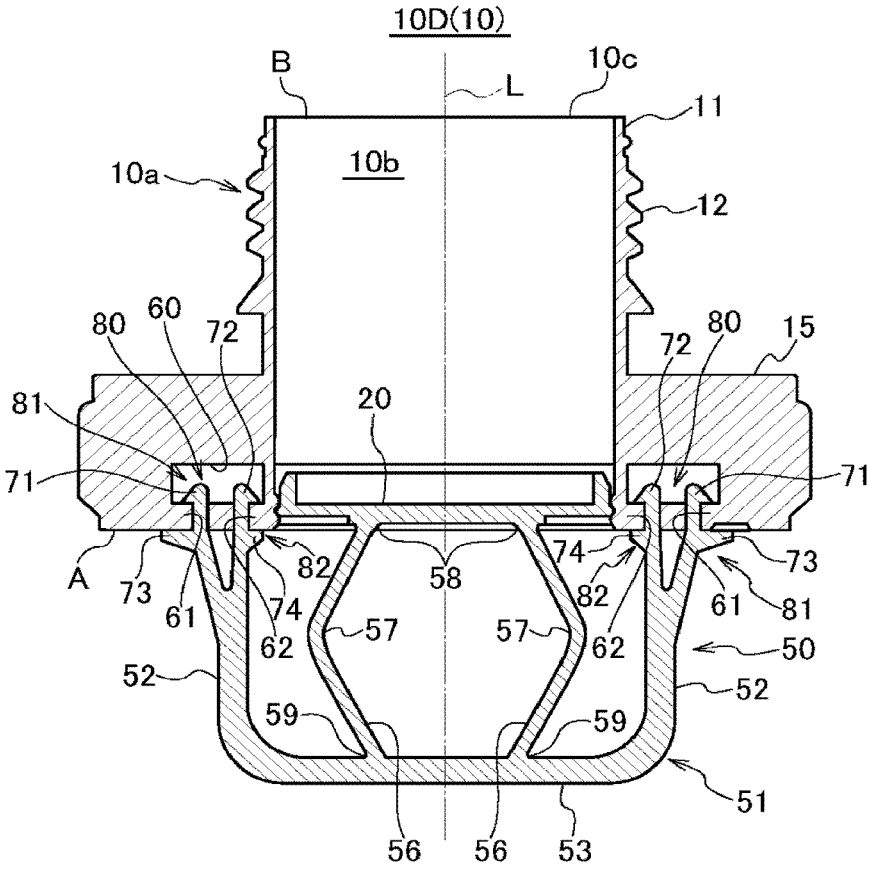
FIG. 11 is a sectional view of the pouring spout that is a separate body from a spout main body part and the energizing body.

FIG. 11 shows an example of a pouring spout 10D constituting the spout main body 10*a* and the energizing body 50 as separate bodies. The pouring spout 10D in this mode differs from the pouring spout 10A illustrated in FIG. 2 and FIG. 3 in components, and includes an attachment mechanism 80 of the spout main body 10*a* and the energizing body 50. However, the components other than the pouring spout 10D are the same as the components of the pouring spout 10A illustrated in FIG. 2 and FIG. 3. Thus, components of the pouring spout 10D that are the same as the components of the pouring spout 10A illustrated in FIG. 2 and FIG. 3 are denoted using the same reference numerals in the drawings, and descriptions thereof are omitted.

In the attached part 15 of this pouring spout 10D, a concave part 60 is formed on an end surface on the inflow port 10*d* side. Convex parts 61, 62 protruding from, among inner surfaces of the concave part 60, the inner surfaces facing each other toward the inner surface on the opposite side are formed on the surface of the concave part 60, that is, the other end B of the attached part 15. The attachment mechanisms 80 for detachably attaching the energizing body 50 to the spout main body 1*a* are provided on the upper parts of the columns 52 constituting the energizing body 50. The attachment mechanisms 80 each include attachment constituting parts 81, 82 forked in left and right directions of FIG. 10 at the upper parts of the columns 52. The attachment constituting parts 81, 82 are configured to return to an original spacing by an elastic force of the attachment mechanism 80 even when the spacing of both is changed. Hooks 71, 72 are provided at positions of upper ends of the attachment constituting parts 81, 82. Further, hooks 73, 74 are provided at positions spaced from the upper end toward a lower side by a predetermined distance as well. The convex parts 61, 62 are configured to be fittable between these hooks 71, 72 and hooks 73, 74.

The mode of attachment of the spout main body 1*a* and the energizing body 50 will now be specifically described with reference to the concave part 60 and the attachment mechanism 80 positioned on the right side of the center of the pouring spout 10D. The convex part 61 protruding to the center from, among the inner surfaces of the concave part 60 formed in the attached part 15, the inner surface positioned on an outer side away from the center, and the convex part 62 protruding to the outer side from the inner surface positioned on the inner side close to the center face each other. The attachment constituting part 81 is engaged with the convex part 61 on the outer side, and the attachment constituting part 82 is engaged with the convex part 62 on the inner side. Specifically, the upper ends of the attachment constituting parts 81, 82 are inserted toward a deep side of the concave part 60, the hooks 71, 72 provided to the upper end are disposed on the upper sides of the convex parts 61, 62, and the hooks 73, 74 on the lower side are disposed on the lower side of the convex parts 61, 62, respectively. With the hooks 71, 72, 73, 74 thus disposed, the convex part 61 is fitted between the hook 71 and the hook 73, and the convex part 62 is fitted between the hook 72 and the hook 74. When the attachment constituting parts 81, 82 are inserted into the interior of the concave part 60, the attachment constituting parts 81, 82 are brought closer to each other, making the space between the two smaller. The hooks 71, 72 thus provided to the upper end pass between the convex part 61 and the convex part 62, and are inserted toward the deep side of the concave part 60.

When the pouring spout 10 of this embodiment is attached to the standing pouch 1 serving as a refill container as described above, the channel 10*b* formed in the interior of the tubular pouring part 11 constituting the pouring spout 10 is closed, making it possible to prevent outside air from flowing into the interior of the standing pouch 1. Further, it is possible to separate the closing member 20 that closes the tubular pouring part 11 of the pouring spout 10 from the spout main body 10*a* and communicate the channel 10*b* without producing broken pieces of the closing member 20 or the like. Furthermore, the channel 10*b* can be closed and opened by the closing member 20, making it possible to prevent the contents remaining in the standing pouch 1 from being exposed to outside air, even when the contents stored in the standing pouch 1 are divided several times to refill the packaging container 30.

DESCRIPTION OF REFERENCE NUMERALS

1 Standing pouch (Refill container)
2 Flat surface part

3 Bottom surface part
4 Crease
10 Pouring spout
10*a* Spout main body
10*b* Channel
10*c* Outlet port
10*d* Inflow port
11 Tubular pouring part
12 Thread part
15 Attached part
16 Side surface part
16*a* Inclined surface part
16*b* Curved part
17 Protruding part
18 Flange
19 Cap
20 Closing member
20*a* Upper surface
20*b* Lower surface
21 Coupling member
30 Packaging container
31 Container main body
32 Handle
40 Pouring unit
41 Main body part
42 Peripheral wall surface
43 Nozzle
50 Energizing body
51 Holding body
52 Column
53 Beam
530 Ring
55 Spring member
56 Spring constituting member
57 Bending part
58 Upper end part
59 Lower end part
60 Concave part
61, 62 Convex part
71, 72, 73, 74 Hook
80 Attachment mechanism
81, 82 Attachment constituting part
A One end in axial direction
B Other end in axial direction
L Extending direction of tubular pouring part

What is claimed is:

1. A pouring spout of a container, comprising:

a spout main body including a tubular pouring part having an inflow port that allows contents to flow in from a container main body and an outflow port that allows the contents to flow out from the tubular pouring part, and an attached part attached to the tubular pouring part such that the inflow port is to be attached to the container main body;

a closing member which is a separate body from the tubular pouring part and fitted to an inner circumferential surface of the tubular pouring part such that the inflow port is openable and closable; and an energizing body comprising a holding body attached to the attached part of the spout main body, and at least one spring member attached to the holding body and connecting the holding body and the closing member, the at least one spring member configured to apply a pressing force to the closing member from a side of the container main body toward the inflow port and close the inflow port by the closing member, wherein the closing member is removable from the inner circumferential surface of the tubular pouring part by an external force applied against the pressing force by the energizing body, and the attached part, the holding body, and the at least one spring member are formed as an integrated object made from a same material by injection molding.

2. The pouring spout of a container according to claim 1, wherein the holding body is positioned to be inserted into an interior of the container main body part.

3. The pouring spout of a container according to claim 2, wherein the attached part, the holding body, and the at least one spring member are integrally formed from the same material selected from the group consisting of polyethylene, polypropylene, polyester, ethylene-vinyl copolymer, and polyvinyl chloride.

4. The pouring spout of a container according to claim 2, wherein the tubular pouring part further includes a thread part formed on an outer circumferential surface of the tubular pouring part.

5. The pouring spout of a container according to claim 2, wherein the closing member has a disk shape.

6. The pouring spout of a container according to claim 1, wherein the attached part, the holding body, and the at least one spring member are integrally formed from the same material selected from the group consisting of polyethylene, polypropylene, polyester, ethylene-vinyl copolymer, and polyvinyl chloride.

7. The pouring spout of a container according to claim 1, wherein the tubular pouring part further includes a thread part formed on an outer circumferential surface of the tubular pouring part.

8. The pouring spout of a container according to claim 7, wherein the attached part, the holding body, and the at least one spring member energizing body are integrally formed from the same material selected from the group consisting of polyethylene, polypropylene, polyester, ethylene-vinyl copolymer, and polyvinyl chloride.

9. The pouring spout of a container according to claim 1, wherein the closing member has a disk shape.

10. The pouring spout of a container according to claim 9, wherein the attached part, the holding body, and the at least one spring member are integrally formed from the same material selected from the group consisting of polyethylene, polypropylene, polyester, ethylene-vinyl copolymer, and polyvinyl chloride.

11. The pouring spout of a container according to claim 1, wherein the holding body of the energizing body has a pair of columns extending from the attached part, and a beam connecting the pair of columns.

12. The pouring spout of a container according to claim 11, wherein the attached part, the holding body, and the at least one spring member are integrally formed from the same material selected from the group consisting of polyethylene, polypropylene, polyester, ethylene-vinyl copolymer, and polyvinyl chloride.

13. The pouring spout of a container according to claim 1, wherein the at least one spring member comprises a plurality of spring members.

14. The pouring spout of a container according to claim 13, wherein the attached part, the holding body, and the at least one spring member are integrally formed from the same material selected from the group consisting of polyethylene, polypropylene, polyester, ethylene-vinyl copolymer, and polyvinyl chloride.

15. The pouring spout of a container according to claim 1, wherein the attached part, the holding body, the at least one spring member, and the closing member are formed as the integrated object made from the same material by injection molding.

16. The pouring spout of a container according to claim 15, wherein the attached part, the holding body, the at least one spring member, and the closing member are integrally formed from the same material selected from the group consisting of polyethylene, polypropylene, polyester, ethylene-vinyl copolymer, and polyvinyl chloride.

17. The pouring spout of a container according to claim 1, wherein the spout main body, the closing member, and the energizing body are formed as the integrated object made from the same material by injection molding.

18. The pouring spout of a container according to claim 17, wherein the spout main body, the closing member, and the energizing body are integrally formed from the same material selected from the group consisting of polyethylene, polypropylene, polyester, ethylene-vinyl copolymer, and polyvinyl chloride.

19. The pouring spout of a container according to claim 17, wherein the spout main body, the closing member, and the energizing body consist of the same material.

20. The pouring spout of a container according to claim 1, wherein the attached part, the holding body, and the at least one spring member consist of the same material.

* * * * *